US006427838B1

(12) United States Patent
Fulda

(10) Patent No.: US 6,427,838 B1
(45) **Date of Patent: *Aug. 6, 2002**

(54) CARD HOLDER AND DISPLAY

(76) Inventor: Chad Fulda, 9975 Butternut St. NW., Coon Rapids, MN (US) 55448

( * ) Notice: Subject to any disclaimer, the term of this patent is extended or adjusted under 35 U.S.C. 154(b) by 0 days.

This patent is subject to a terminal disclaimer.

(21) Appl. No.: 09/591,979

(22) Filed: Jun. 12, 2000

Related U.S. Application Data

(63) Continuation-in-part of application No. 09/148,255, filed on Sep. 4, 1998.
(60) Provisional application No. 60/058,076, filed on Sep. 5, 1997.

(51) Int. Cl.[7] ..... B65D 85/48
(52) U.S. Cl. ..... 206/455; 206/748
(58) Field of Search ..... 206/6.1, 308.3, 206/449, 455, 483, 736, 748; 150/145, 147, 149; 383/39, 40

(56) References Cited

U.S. PATENT DOCUMENTS

| | | | | |
|---|---|---|---|---|
| 2,036,341 A | | 4/1936 | Lemburg | |
| 2,763,311 A | | 9/1956 | Sparrow | |
| 3,069,168 A | | 12/1962 | Feldman et al. | |
| 3,334,677 A | | 8/1967 | Toomey | |
| 3,435,868 A | | 4/1969 | Stermer | |
| 3,565,148 A | | 2/1971 | Miller | |
| 4,058,916 A | * | 11/1977 | Whyatt | 40/107 |
| 4,629,070 A | | 12/1986 | Roberg | |
| 4,979,619 A | | 12/1990 | Hager | |
| 5,087,145 A | * | 2/1992 | Cooley | 402/79 |
| 5,159,964 A | | 11/1992 | Baker et al. | |
| 5,224,600 A | | 7/1993 | Neugebauer | |
| 5,291,990 A | | 3/1994 | Sejzer | |
| 5,337,949 A | * | 8/1994 | Seeley | 229/92.8 |
| 5,427,230 A | * | 6/1995 | Mattox | 206/6.1 |
| 5,779,033 A | | 7/1998 | Roegner | |
| 5,816,392 A | | 10/1998 | Kawagoe et al. | |
| 6,073,769 A | * | 6/2000 | Fulda | 206/455 |

* cited by examiner

*Primary Examiner*—David T. Fidei
(74) *Attorney, Agent, or Firm*—Patterson, Thuente, Skaar & Christensen, P.A.

(57) ABSTRACT

A flexible card holder and display which enables a plurality of cards to be attached, transported, displayed, and stored. The card holder comprises a sheet of thin, tear-resistant material into which a plurality of slits have been cut. The slits are arranged so as to receive portions of cards, thereby releasably retaining the cards on the sheet. The card holder is lightweight, portable, and foldable into a variety of compact configurations. The card holder may be provided with an aperture at one end to enable the card holder to be suspended, thus displaying cards which are releasably attached thereto. The card holder further may be adapted to store in a multiring binder. Removable stiffeners may also be employed to facilitate hanging the device upon removal from the binder.

20 Claims, 6 Drawing Sheets

1
10
11
12
13A
13B
13C
13D
14
15
16
17A
17B
17C
17D
18
19
20
21
22
23
30
31
32
33
50A
50B
50C
50D
A
B

CARD HOLDER AND DISPLAY

This utility application is a continuation in part of copending patent application Ser. No. 09/148,255 filed on Sep. 4, 1998 which is based on U.S. Provisional Patent Application No. 60/058,076, filed Sep. 5, 1997.

BACKGROUND OF THE INVENTION

The present invention relates generally to a card transporter and display, and more particularly to a sheet of flexible material which can releasably retain an array of trading card holders.

Trading cards have been in existence for many years. They have been available for sale directly or as premiums associated with other merchandise. Up until recently, trading card collections and collectors have generally been the province of youngsters, and the occasional adult. That has changed. Today, there are serious trading card collectors of all ages who collect premium trading cards. Because of the costs involved, collectors have become more sophisticated and they are likely to purchase trading card holders so that bare hands do not touch trading cards themselves.

The problem with these holders is that they take up a lot of space and it is difficult to show off one's collection. Also, many collectors travel from trade show to trade show as exhibitors. It takes time to set up and break down a display booth. With existing exhibits, there is always the chance that a trading card may be misplaced and never seen by the public, or worse, lost during the frequent packing and unpacking. Also, there are many people who identify with a particular sport or team. Trading cards may be incidental to them, yet important enough to warrant prominent display in a recreation room, or den, for example.

There is a need for a device which can be used to transport, store, and display trading cards in an attractive and easily discerned manner.

SUMMARY OF THE INVENTION

A flexible card transport and display device which enables a plurality of cards to be attached, transported, displayed, and stored. The card transport and display device comprises a sheet of thin, tear-resistant material into which a plurality of card holder retaining elements in the form of slits have been cut. The slits are arranged so as to receive the comers of card holders, flat transparent enclosures used to protect trading cards, thereby releasably retaining the card holders on the sheet. The card transport and display device is lightweight, portable, and foldable into a variety of compact configurations.

One embodiment of the card transport and display is provided with an upper support and an aperture at one end to enable the card transport and display be suspended, thus displaying cards which are releasably attached thereto.

In a second embodiment, the card transport and display does not include the upper support. Thus, when a plurality of cards (i.e., transparent trading card holders with trading cards) are attached to the sheet, a plurality of preferential fold lines are defined. Although the fold lines are orthogonal to the cards, diagonal spacing may be achieved by providing enough space between adjacent cards. Due to the flexible nature of the sheet and the relative widths of the fold lines defined by the cards, the sheet with cards attached may be folded into many configurations.

In yet another embodiment of the invention it may be adapted to display cards in a binder, such as a standard three ring binder. In this embodiment it is preferred that the sheet of thin flexible tear resistant material of the card transport and display device be transparent so that both sides of the cards in their individual holders may be observed. In this embodiment a series of apertures are provided along at least one edge of the card transport and display device. The apertures are spaced to align with the rings of the binder to allow securing of the device thereto. In addition a number of notched or slotted apertures may be provided. In the case of a large sheet of cards, these are placed so that when the card transport and display device is folded for storage within the binder they coincide with the location of the binder rings and may be releasably connected to the rings by pressing the ring through the slot or notch until it engages within the aperture. This may be accomplished without opening the binder rings. A gentle pull then releases the card transport and display device for unfolding for display. If desired, the card transport and display device may be removed from the binder for hanging or other display by opening the rings.

A principal object and advantage of the present invention is to enable a large number of trading cards to be easily stored.

Another object and advantage of the invention is to enable a large number of trading cards to be easily transported.

Another object and advantage of the invention is to enable a large number of trading cards to be easily displayed.

Yet another object and advantage is the provision of a flexible, tear-resistant backing or sheet onto which trading cards are releasably attached.

Another object and advantage of the invention is the formation of preferential fold lines that occur when transparent trading cards holders are attached to the flexible sheet.

Still another object and advantage is to enable selective portions of the sheet and attached trading cards to be easily displayed.

Yet another object and advantage is to provide increased protection from the elements when the sheet and trading cards are bundled-up for transport and storage.

These, and other objects, features, and advantages of the invention will become more readily apparent to those skilled in the art from the detailed description and the accompanying drawings.

DETAILED DESCRIPTION

Figures 1, 2, 3:
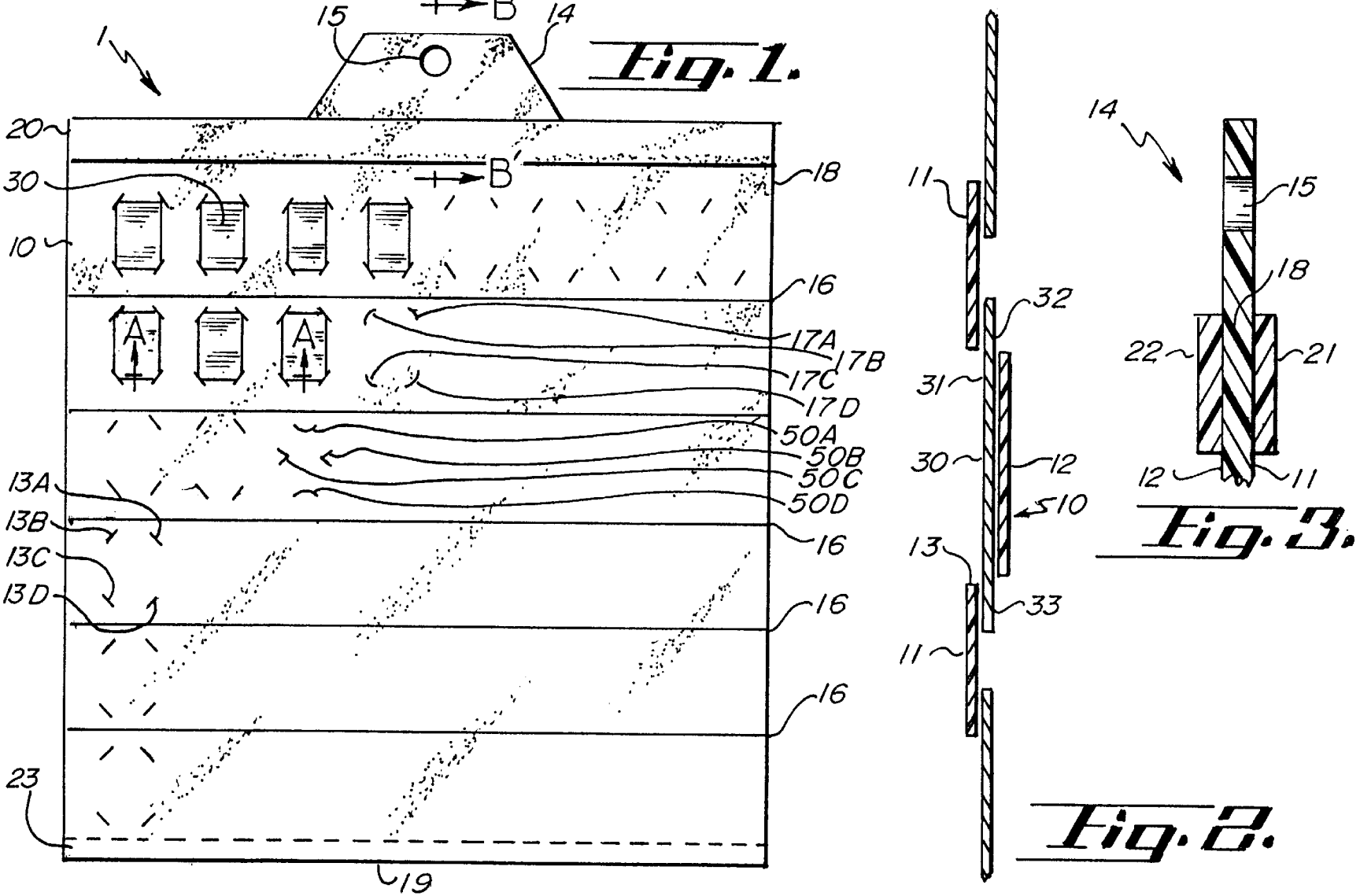
FIG. 1 is a plan view of the invention.
FIG. 2 is a cross-sectional view taken along line A–A' of FIG. 1.
FIG. 3 is a cross-sectional view taken along line B–B' of FIG. 1.

Referring to FIGS. 1 through 4, the card transport and display device is shown and is generally designated with the numeral 1. The card transport and display device 1 generally comprises a sheet or backing 10 into which a plurality of slits 13 have been cut. The slits are sized and arranged such that portions of a card holder 30 project therethrough, thereby releasably retaining the card holder to the sheet or backing 10. The sheet or backing 10 is provided with a tab 14 which extends beyond a first end 18, with the tab having an aperture 15 therethrough to enable the sheet to be suspended. The sheet is also provided with an upper support 20 adjacent the tab 14 which serves to prevent upper edges of the sheet from curling downwardly when the card transport and display device is suspended. The upper support 20 extends generally along the length of the first end 18 such that the entire width of the sheet or backing 10 is uniformly suspended. The upper support 20 also serves to reinforce the card transport and display device when it has been furled or folded into a bundle for transport or storage.

Turning to FIG. 1 card transport and display device 1 comprises a sheet or backing 10 which has a front facing side 11 and a rear facing side (not shown). Although the sheet 10 is preferably made from a commercially produced vinyl laminated polyester under the name Protexit™, manufactured by the John Boyle & Company, Inc., Statesville, N.C.; other tear resistant material may be used. The sheet 10 is provided with a plurality of slits 13A–D and 17A–D, for example which serve to releasably retain a card holder 30. The slits are sized and arranged to admit corners or projections 33 of a card 30.

For purposes of clarification in this application, the term "card holder" is construed to mean a generally planar article which may be adapted to releasably contain a generally flat article, wherein the generally flat article is a trading card, a data storage disc, or the like. In that vein, the preferred "card holder" of the invention is a transparent, relatively rigid sleeve sized to receive and retain a trading card.

The shape of the slits need not be as straight as in 13A–D, but may be arcuate 17A–D if desired. The number of slits 13 can vary, according to the shape of the card holder to be releasably retained. For example, a card holder which has the outline of a star with five arms or projections would be provided with five slits, even though each arm need be inserted into each slit to retain the card holder on the sheet. If desired, however, three slits would suffice. In this preferred embodiment, however, the cards holders in an array of rows and columns, with the rows separated by, and which define a plurality of parallel lines 16 about which the sheet 10 with card holders attached thereto, may be folded.

In an alternative embodiment, a plurality of slits are sized and arranged such that a plurality of projections 50A, 50B, 50C, and 50D are formed. When this embodiment is used, the projections 50A, 50B, 50C, and 50D are arranged is such a fashion that they overlay portions of a card holder, thus releasably retaining a card holder to the sheet or backing 10.

The sheet or backing 10 may also be provided with a lower support 23 (shown in dashed lines) which is adjacent the second end 19 of sheet 10. The lower support 23 serves to prevent lower edges of the sheet from curling and adds rigidity to the card transport and display device when it is furled or folded for transport or storage. The structure of the lower support 23 is the same as the structure of the upper support 20 which is depicted in FIG. 3 and described below. Therefore, it will not be depicted and further described.

Referring to FIG. 2, the juxtaposition between the sheet or backing 10 and card holder 30 may be more easily seen. To retain a card holder 30 as shown in FIG. 1 onto the sheet or backing 10, the comers or projections 33 of the card holder 30 are inserted into corresponding slits 13A–D or 17A–D such that the comers or projections 33 of the front facing side 31 of the card holder 30 are adjacent the rear facing side 12 of the sheet, and the rear facing side 32 of the card holder 30 is adjacent the front facing side 11 of the sheet or backing 10.

Referring to FIG. 3, the structure of the upper support 20 may be more easily seen. The sheet or backing 10 is provided with a tab 14 at one end thereof, with the tab having an aperture 15 therethrough to enable the sheet to be suspended. The sheet is also provided with an upper support 20 adjacent the tab 14 which serves to prevent upper edges of the sheet from curling downwardly when the card transport and display device is suspended. The upper support 20 comprises a front facing slat 21 and a rear facing slat 22 which are affixed adjacent the first end 18 of the sheet 10, on the front facing side 11 and the rear facing side 12, respectively.

Figure 10:
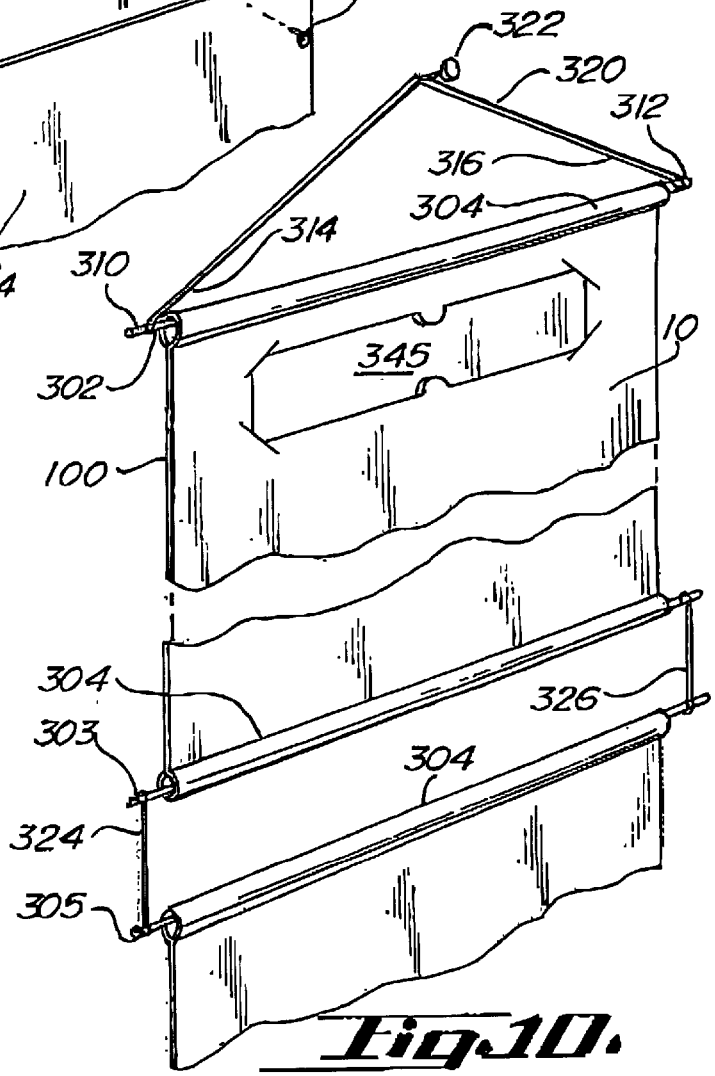
FIG. 10 depicts the invention including sleeves and stiffening members as displayed (slits not shown for clarity).

In FIG. 10 card holding slits and fold lines are not shown for clarity. Referring to FIG. 10, backing sheet 10 may be provided with stiffening members 302. Sleeves 304 may be provided to receive the stiffening members. A stiffening member 302 may thus be easily inserted into or removed from the sleeve 304.

Figure 11:
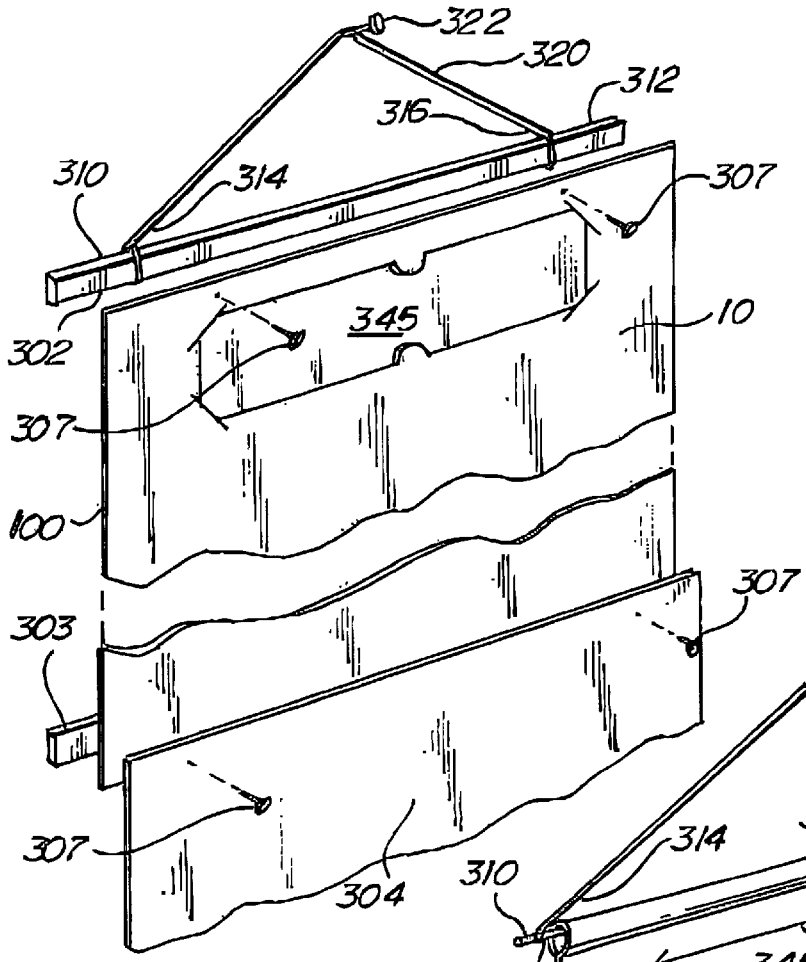
FIG. 11 depicts an alternate embodiment of the invention including stiffening members (slits not shown for clarity).

Referring to FIG. 11, stiffening members 302 may also be secured to the backing sheet 10 by fasteners 307 such as thumbtacks, push pins or screws. Although the use of two stiffening members 302 per backing sheet 10 is depicted, it is understood that one of the stiffening members 302 may be omitted if desired. Removal of the stiffening members allows the card transport and display device to be folded or furled as in other embodiments.

The stiffening members may further be adapted near each end 310, 312 to receive the ends 314, 316 of a cord or flexible strap 320, which can then be placed over a hanger 322 to support the card transport and display device for showing. Fasteners 307 may also secure the elongate flexible member to the stiffening member 302. Additionally, a first card transport and display device with upper and lower stiffening members may be hung, then a second and additional card transport and display devices may be suspended below and from the first by connecting a second cord 324 and a third cord 326 from each end of the lower stiffening member 303 of the first unit to each end of the upper stiffening member 305 of the second unit. Alternately, the lower stiffening member 303 of the second card transport and display device may be directly connected to the lower stiffening member of a first card transport and display device by fasteners 307.

Fasteners 307 may also be used to hang the card transport and display device 1 from a structure such as a wall or display frame.

In addition to slits 13 for retaining card holders 30, still referring to FIG. 10, slits may be configured to receive and releasably retain signage 345, For example, a display of cards of a sports team might include a sign 345 identifying the name of the team. Slits 13 may be configured to position a sign 345 horizontally, vertically or in some other orientation. The sign 345 may coincide with one row or column, cross several rows or columns, or cross both rows and columns. By proper spacing of retaining slits 13 and sizing of a sign 345 some slits 13 may serve to retain a sign 345 interchangeably with retaining card holders.

Figure 4:
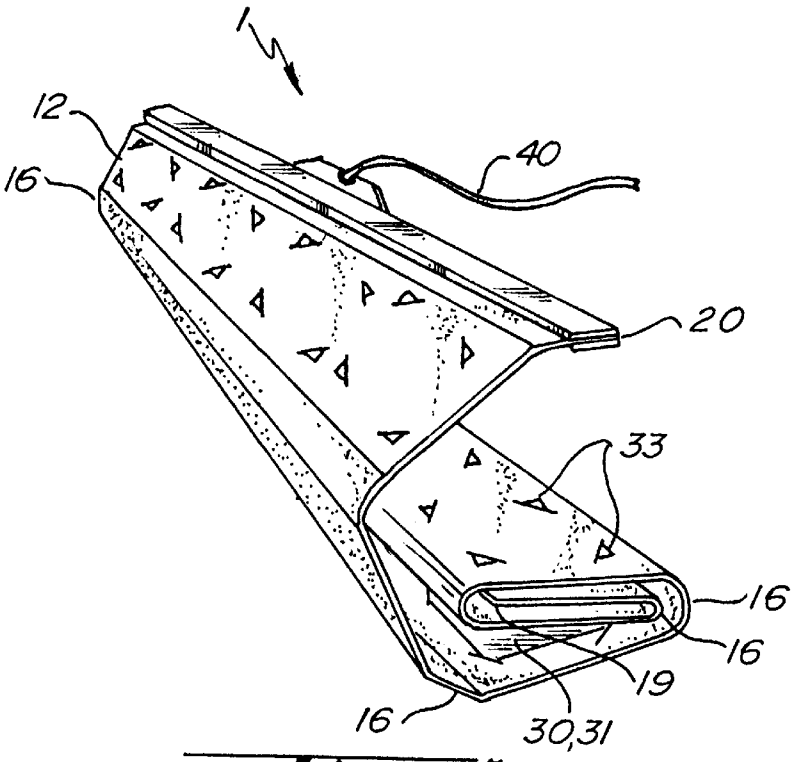
FIG. 4 is a perspective view of the invention in a partially folded state.

Referring to FIG. 4, the card transport and display device 1 is in a partially folded state. Here, the sheet or backing 10 has been partially folded or furled about lines 16 in a circular fashion. Preferably, the folding or furling operation starts at he second end 19 of the sheet 10 wherein the front facing side of the sheet 11 is folded against itself. As shown in the figure, the front sides 31 of cards 30 are thus protected. Note that as the first end of the sheet or backing is folded into position, only the corners or projections 33 of cards 30 are visible from the rear facing side 12 of the sheet. Although the sheet in this embodiment is furled, it is understood that other methods of folding the sheet may be employed without departing from the spirit and scope of the invention.

Referring to FIGS. 1–4, operation will now be discussed. In use, the card transport and display device 1 is unfolded or unfurled to expose a front facing side 11. A card holder or card holders 30 are then attached to the sheet 10 by inserting the corners or projections 33 of the card holders into slits 13A–D, 17A–D. If the card holder or card holders are to be displayed, the card transport and display device may be suspended by utilizing the aperture 15, in tab 14 which extends from a first end 18 of the sheet 10. If the card holder or card holders are to be stored or protected, the sheet is preferably furled along lines 16 starting at a second end 19 of the sheet. As the tab 14 is furled about the body of sheet 10, the resulting bundle may be secured with a closure 40.

Referring to FIGS. 5 and 6A through 6D, the card transport and display device is shown and is generally designated with the numeral 100. The card transport and display device 100 generally comprises a sheet or backing 110 into which a plurality of slits 120, 122, 124, and 126 have been cut. The slits are sized and arranged such that portions of a card holder 130 project therethrough, thereby releasably retaining the card to the sheet or backing 110. Preferably, slits 120, 122, 124, 126 are arranged to enable an array of cards in card holders to be displayed in a plurality of rows (162, 164, 166, 168) and columns (171, 173, 175, 177) with the rows and columns separated by, and which define, parallel fold lines 140, 150.

Although a four-by-four matrix is shown, it is understood that additional rows and columns may be provided to enable a larger array of cards in card holders to be displayed; for example, an entire athletic team.

Figure 5:
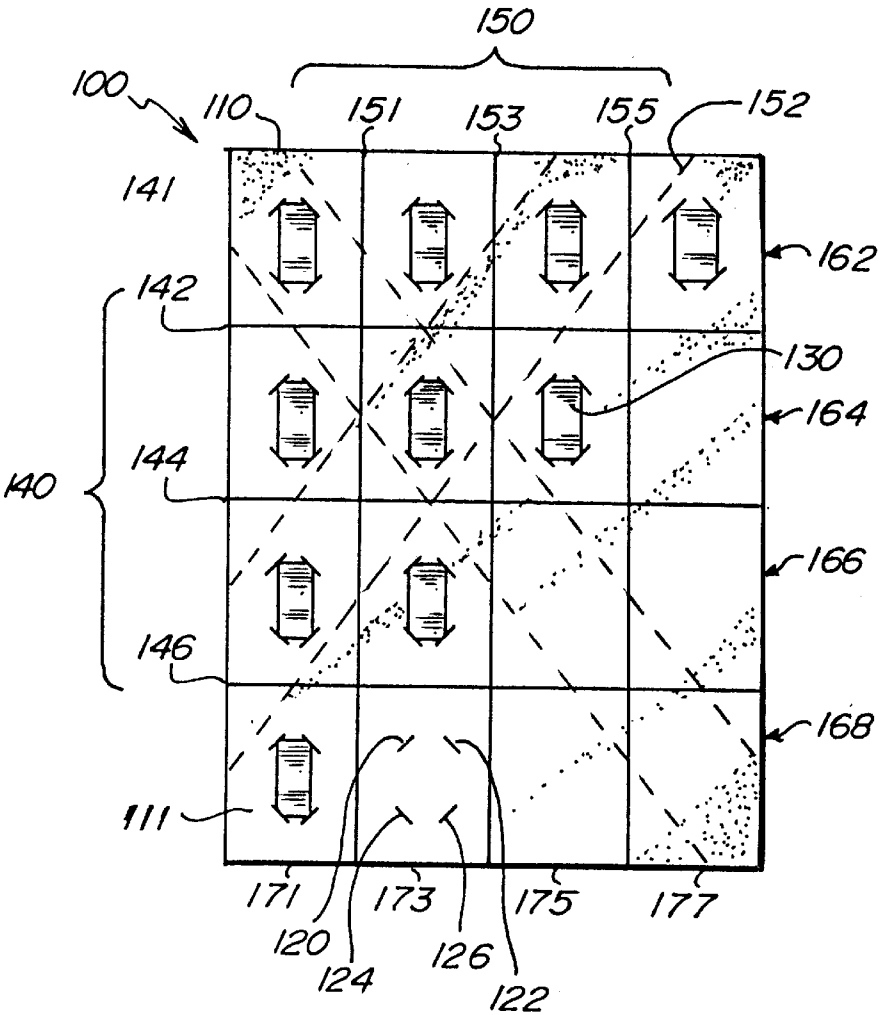
FIG. 5 is a plan view of a second embodiment of the invention.

Referring to FIG. 5, card transport and display device 100 comprises a sheet or backing 110 which has a front facing side 111 and a rear facing side 112 (not shown). As mentioned above, sheet 110 is preferably made from a vinyl laminated polyester known commercially as name Protexit™. However, other tear-resistant material may be used. As with the first embodiment of FIGS. 1–4, sheet 110 is provided with a plurality of slits 120, 122, 124, 126, which serve to releasably retain a card 130. The slits are sized and arranged to admit corners or projections of a card 130, as described and shown above in FIGS. 1 and 4.

As with the first embodiment shown and described above, the shape of the slits need not be straight as depicted in 120–126, but may be arcuate if desired. Additionally, the number of slits can vary, according to the shape of the card holder to be releasably retained. Note that the slits 120–126 are preferably arranged such that they create a plurality of parallel lines 142, 144, 146, and 151, 153, 155 about which the sheet 110 with cards attached thereto, may be folded.

With regard to the arrangement of the slits, it is envisioned that such arrangement may take other forms. So, for example, spacing between the groups of slits may be increased to enable the cards of the card transport and display device to define a plurality of additional, diagonal fold lines. Additionally, the groups of slits may be arranged along curved portions such as circles and waves instead of the preferred linear arrangement. And, although the preferred embodiment depicts rectangularly-shaped card holders in a vertical orientation, it is envisioned that the card holders may be oriented horizontally, if desired.

Figure 6A:
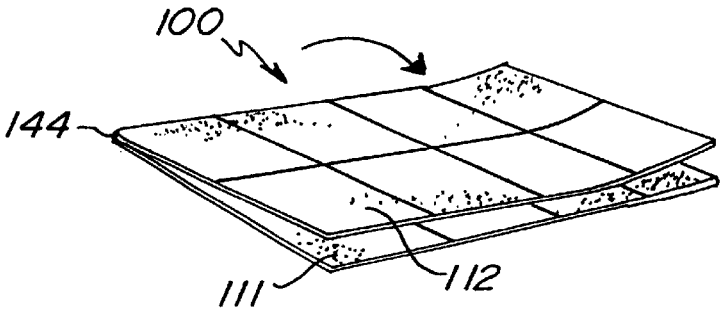
FIGS. 6 to 6D depict the second embodiment of FIG. 5 as it is folded into a compact form.
Figure 6B:
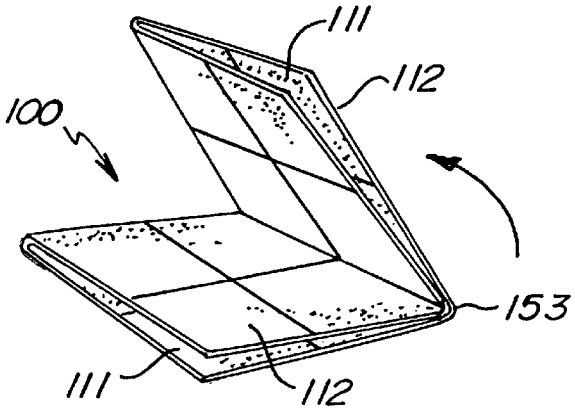
Figure 6C:
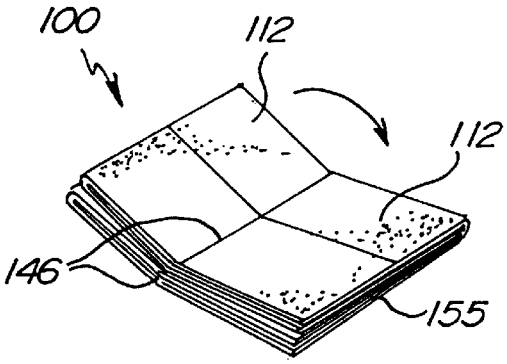
Figure 6D:
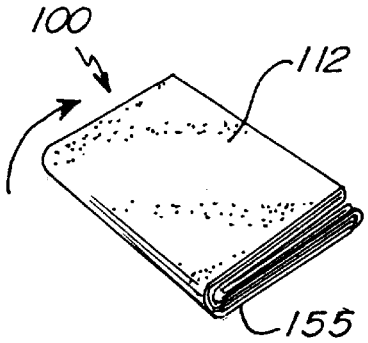

Referring to FIGS. 6A through 6D, the operation will now be discussed. These figures indicate one of many configurations into which the card transport and display device may be folded. Note that card holders and slits are not depicted. In this particular sequence, the rear facing side 112 is in a position where card holders are protected by sheet 110. To form this particular bundle, card transport and display device 100 is folded about line 144 so that the card transport and display device is halved FIG. 6A. In FIG. 6B, the card transport and display device is folded about line 153 so that the card transport and display device is again halved. In FIG. 6C, the card transport and display device is folded about line 146 so that the card transport and display device is halved again. Lastly, in FIG. 6D, the card transport and display device is folded about line 155 so that the card transport and display device is in a compact form for transportation and/or storage. As with the first embodiment, the transport/storage package may be provided with a closure (not shown) and/or a protective container (also not shown).

Although the aforementioned figures depict a configuration which is folded symmetrically to produce a card transport and storage package, it is understood that other folding configurations may be used. For example, the folds may be asymmetrical so that selected portions of the front facing surface of the card transport and display device display may be displayed. Or, the card transport and display device may be folded accordion-style; furled along a column or row; or folded using a combination of furls and folds.

In yet another embodiment of the invention it may be adapted to display cards in a binder, such as a standard three ring binder. In this embodiment it is preferred that the sheet of thin flexible tear resistant material of the card transport and display device be transparent so that both sides of the cards in their individual cardholders may be observed though opaque material may be used.

Figure 9C:
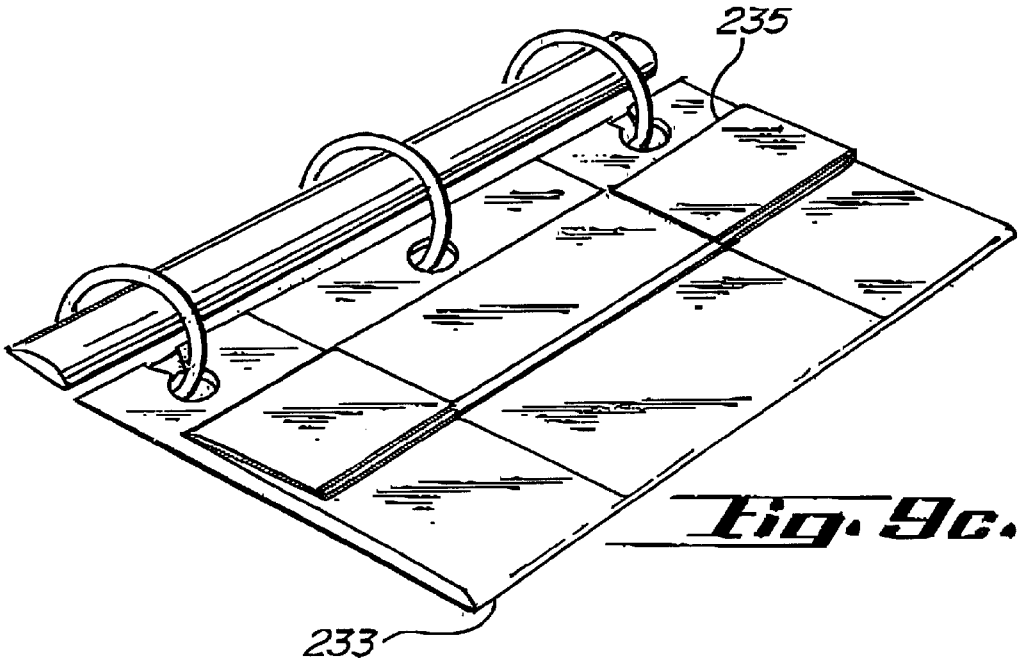
FIGS. 9*a*, 9*b* and 9*c* depict an exemplary folding sequence for storing an embodiment of the invention in a ring binder (slits not shown for clarity).
Figure 7:
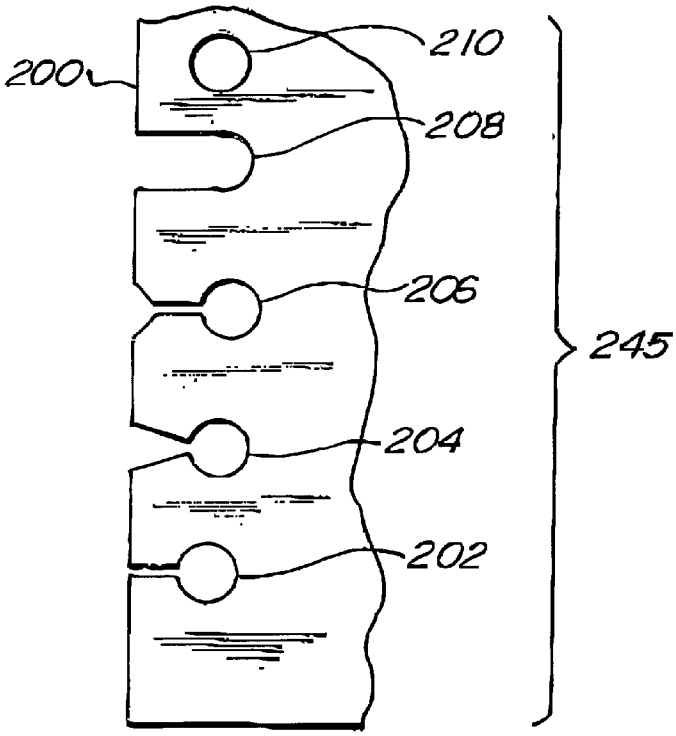
FIG. 7 depicts various types of slotted apertures.
Figure 8:
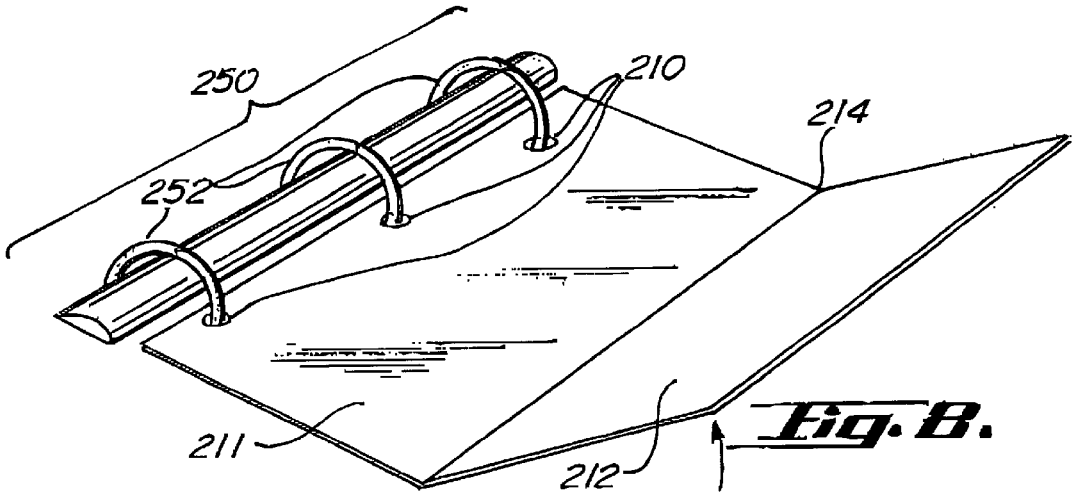
FIG. 8 depicts an embodiment of the invention that is adapted to store in a ring binder (slits not shown for clarity)
Figure 9A:
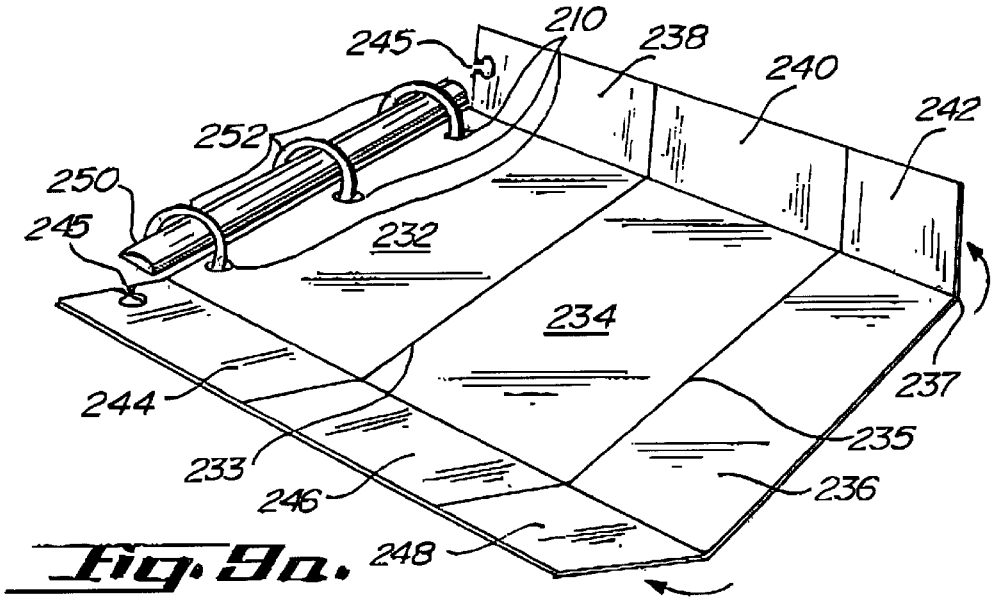
Figure 9B:
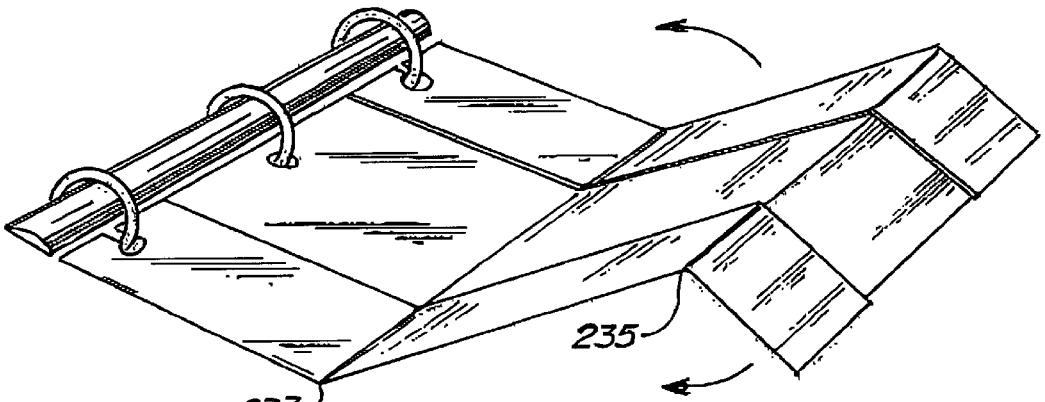

Referring to FIGS. 7, 8 and 9 a series of apertures 210 are provided on the periphery of the card transport and display device along at least one edge. The apertures 210 are spaced to align with the rings 252 of the binder to allow securing of the device thereto. In addition, a number of notched or slotted apertures 245 may be provided to facilitate folding.

Notched or slotted apertures, collectively 245, may take a number of forms. They may comprise an aperture with a slit 202 communication to the near edge 200 of the card transport and display device. They may comprise an aperture and V shaped notch 204, a combination of a slit and a notch 206 or a U shaped cutout 208. Referring to FIG. 8, these are placed so that when the card transport and display device is folded for storage within the binder 252 they coincide with the location of the binder rings 252 and may be releasably engaged to the rings 252 by pressing the ring 252 through the slot or notch until it engages within the aperture 245. A gentle pull then releases the card transport and display device for unfolding and display. If desired, the card transport and display device may be removed from the binder for hanging or other display by opening the rings 252. This embodiment may also include removable stiffening members 302 or sleeves 304 and removable stiffening members 302 for hanging as revealed in other embodiments Referring to FIG. 8, an embodiment of the card transport and display device with apertures 210 is depicted with the apertures 210 engaged into a ring binder assembly 250 including rings 252. Card holders and slits are not shown for clarity. Apertures 210 are arranged in a row along at least one edge. The depicted device has two panels 211, 212 separated by fold line 214. When storage is desired panel 212 is folded to lie on top of panel 211. Of course, additional panels may be included and be folded accordion style without departing from the spirit and scope of the invention.

Referring to FIG. 9, another embodiment of the card transport and display device is depicted engaged into ring binder assembly 250, including rings 252. Again, card holders and slits are not shown for clarity. In this embodiment the card transport and display device is divided into central panels 232, 234, and 236 divided by fold lines 233 and 235. In addition upper panels 238, 240, 242 are separated from central panels 232, 234, 236 by fold line 237 and lower panels 244, 246, 248 are separated from central panels 232, 234, 236 by fold line 239. Apertures 210 pierce central panel 232. Upper and lower panels 238 and 244 are perforated by slotted apertures 245. While slotted apertures shown in FIG. 9 comprise a V shaped notch communicating with a round aperture, it is understood that any type of slotted aperture may be employed without departing from the spirit and scope of the invention.

When storage is desired, FIG. 9*c*, upper panels 238, 240, 242 are folded about fold line 237 to lie upon central panels 232, 234, 236 as are lower panels 244, 246, 248. This brings slotted apertures 245 into engagement with rings 252. Then, FIG. 9*b*, central panel 234 is folded about fold line 233 to lie atop central panel 232, at the same time central panel 236 is folded accordion style about fold line 235 to lie atop central panel 234. FIG. 9*c* depicts the unit folded. Many other panel arrangements and folding schemes may be employed without departing from the spirit and scope of the invention.

The present invention may be embodied in other specific forms without departing from the spirit or essential attributes thereof; and it is, therefore, desired that the present embodiments be considered in all respects as illustrative and not restrictive, reference being made to the appended claims rather than to the foregoing description to indicate the scope of the invention.

I claim:

1. A card transport and display device in combination with a plurality of transparent card holders, the card holders each having four corners and sized to receive and retain trading cards, the device comprising a sheet of flexible material, the sheet having a plurality of slits, each slit positioned to receive one of the four comers of the plurality of the card holders and the slits further positioned such that each comer of each card holder may be received thereby retaining the card holder in the sheet material, the slits positioned to arrange the card holders in a plurality of rows with a fold line being defined intermediate each row, whereby the sheet material with the card holders retained thereby may be folded up, the sheet having an upper edge, a lower edge and width further comprising a first stiffening member, removably coupled to the sheet extending, the width of the sheet along at least one of the upper or lower edges.

2. The card transport and display device of claim 1 wherein the slits are further positioned such that the card holders retained therein define a plurality of columns with a fold line being defined intermediate each column.

3. The card transport and display device of claim 1, the first stiffening member having two ends, and further comprising an elongate flexible member having two ends, the stiffening member adapted to releasably receive and retain the ends of the flexible member for hanging the card transport and display device.

4. The card transport and display device of claim 1, having a periphery defining a plurality of apertures therethrough, in which the apertures are spaced and arrayed to allow the apertures to engage a plurality of multiring binder rings.

5. The card transport and display device of claim 4, in which at least one of the plurality of apertures includes a slotted aperture which allows engagement to and disengagement from the binder rings without opening the rings.

6. The card transport and display device of claim 1, in which at least some of the slits are space and arrayed to receive and retain a sign displaying indicia.

7. A card transport and display device in combination with a plurality of transparent card holders, the card holders each having four comers and sized to receive and retain trading cards, the device comprising a sheet of flexible material, the sheet having a plurality of slits, each slit positioned to receive one of the four comers of the plurality of the card holders and the slits further positioned such that each comer of each card holder may be received thereby retaining the card holder in the sheet material, the slits positioned to arrange the card in a plurality of columns with a fold line being defined intermediate each column, whereby the sheet material with the card holders retained thereby may be folded up, the sheet having at least one edge defining a plurality of apertures spaced and arrayed to engage a plurality of rings in a multiring binder.

8. The card transport and display device of claim 7, in which at least some of the apertures are slotted apertures which allow the engagement to and disengagement from the binder rings without opening the rings.

9. The card transport and display device of claim 7, having an upper edge, further comprising a selectively attachable stiffening member along the upper edge, the stiffening member having two ends, the ends adapted to releasably engage an elongate flexible member to facilitate the hanging of the card transport and display device.

10. The card transport and display device of claim 7, having a lower edge, further comprising a selectively attachable stiffening member.

11. The card transport and display device of claim 7, in which at least some of the slits are spaced and arrayed to receive and retain a sign.

12. The card transport and display device of claim 7 wherein the slits are further positioned such that the card holders retained therein define a plurality of rows with a fold line being defined intermediate each row.

13. A method of transporting a plurality of card holders, the transparent card holders having four corners and each card holder configured to retain and display a trading card, the method comprising the steps of:

a) providing a sheet of flexible material with a plurality of slits arranged to receive the corners of the card holders, each slit receiving only one corner of one card holder, the slits arranged to position the plurality of card holders in an array with at least one of a plurality of rows and a plurality of columns; the sheet further comprising at least one stiffening member selectively attachable thereto, the sheet further having at least one edge defining a plurality of apertures, at least some of which are slotted apertures, space and arrayed to engage the rings of a multiring binder, having a cover, and b) inserting a plurality of card holders in the slits to define a plurality of fold lines between the at least one of a plurality of rows and a plurality of columns; and c) engaging the apertures to the rings of a multiring binder and closing the rings d) removing the stiffening members, if present, and e) folding the sheet upon the fold lines to engage the slotted apertures with the binder rings, without opening the rings, and f) further folding the sheet upon the fold lines to fit between the covers of the multiring binder, and g) closing the binder and transporting the binder and the enclosed card transport and display device.

14. A method of displaying a plurality of card holders, the transparent card holders having four comers and each card holder configured to retain and display a trading card, the method comprising the steps of:

a) providing a sheet of flexible material with a plurality of slits arranged to receive the comers of the card holders, each slit receiving only one comer of one card holder, the slits arranged to position the plurality of card holders in an array with at least one of a plurality of rows and a plurality of columns; the sheet adapted to receive a first stiffening member along an upper end and a second stiffening member along a lower end b) inserting a plurality of card holders in the slits to define a plurality of fold lines between the at least one of a plurality of rows and a plurality of columns;

c) attaching a first stiffening member having two ends along the upper end, engaging the stiffening member to an elongate flexible member, d) hanging the elongate flexible member upon a hanger.

15. The method of claim 14 further comprising the step of e) attaching a second stiffening member having a first end and a second end along the lower end of the sheet.

16. The method of claim 15 further comprising the step of f) providing a third stiffening member, coupling the third stiffening member to the second stiffening member thereby allowing the hanging of additional card transport and display devices therebelow.

17. A card transport and display device in combination with a plurality of flat transparent enclosures, the enclosures having four comers, the device comprising a sheet of flexible material, the sheet having a plurality of slits spaced and arrayed to receive and retain the corners of the enclosures, the plurality of slits are further arrayed so that the enclosures thereby retained define a plurality of rows and columns further defining fold lines therebetween. the device having an upper edge and a lower edge, being adapted along at least on of the upper and lower edges, to receive a stiffening member, the stiffening member adapted to engage an elongate flexible member, the flexible member thereby supporting the card transport and display device from a hanger.

18. A card transport and display device in combination with a plurality of flat transparent enclosures, the enclosures having four corners, the device comprising a sheet of flexible material, the sheet having a plurality of slits spaced and arrayed to receive and retain the comers of the enclosures, the device having two side edges, at least one of the side edges defining apertures therethrough, the apertures spaced and arrayed to engage a plurality of rings of a multiring binder, the apertures including at least one slotted aperture which allows the engagement to and disengagement from the rings without the opening thereof.

19. A card transport and display device in combination with a plurality of transparent card holders, the card holders each having four corners and sized to receive and retain trading cards, the device comprising a sheet of flexible material, the sheet configured for releasably retaining the plurality of transparent card holders in a plurality of columns and a plurality of rows, the sheet having a plurality of fold lines, the sheet having at least one edge with a plurality of apertures spaced and arrayed to engage a plurality of rings in a multiring binder whereby the sheet material with the card holders retained therein may be folded up and placed in a multiring binder.

20. A trading card transport and display device in combination with a multiring binder, the card holders each having four corners, sized to receive and retain trading cards, the device comprising a sheet of flexible material, the sheet configured for releasably retaining the plurality of trading cards in a plurality of columns and a plurality of rows, the sheet having a plurality of fold lines including at least one horizontal fold line and a vertical fold line, the sheet having at least one edge with a plurality of apertures spaced and arrayed to engage a plurality of rings in a multiring binder whereby the sheet material with the trading cards retained therein may be folded up and placed in the multiring binder with the plurality of apertures engaged with the plurality of rings.

* * * * *